US010443155B2

(12) United States Patent
Meier

(10) Patent No.: US 10,443,155 B2
(45) Date of Patent: Oct. 15, 2019

(54) CARDING APPARATUS AND CARDING METHOD

(71) Applicant: AUTEFA SOLUTIONS GERMANY GMBH, Friedberg (DE)

(72) Inventor: Andreas Meier, Affing (DE)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 309 days.

(21) Appl. No.: 15/121,640

(22) PCT Filed: Feb. 26, 2015

(86) PCT No.: PCT/EP2015/053961
§ 371 (c)(1),
(2) Date: Aug. 25, 2016

(87) PCT Pub. No.: WO2015/128391
PCT Pub. Date: Sep. 3, 2015

(65) Prior Publication Data

US 2016/0362818 A1 Dec. 15, 2016

(30) Foreign Application Priority Data

Feb. 27, 2014 (DE) ..... 20 2014 100 908 U

(51) Int. Cl.
*D01G 15/10* (2006.01)
*D01G 21/00* (2006.01)
(Continued)

(52) U.S. Cl.
CPC ..... *D01G 15/10* (2013.01); *D01G 15/28* (2013.01); *D01G 15/42* (2013.01); *D01G 21/00* (2013.01); *D04H 18/02* (2013.01); *D04H 18/04* (2013.01)

(58) Field of Classification Search
CPC ..... D01G 15/02; D01G 15/10; D01G 21/00
See application file for complete search history.

(56) References Cited

U.S. PATENT DOCUMENTS 3,097,399 A * 7/1963 Alston ..... D01G 15/04 19/98
3,249,967 A * 5/1966 Varga ..... D01G 15/02 19/106 R
(Continued)

FOREIGN PATENT DOCUMENTS

CN 1213716 A 4/1999
DE 3 617 862 A1 12/1987
(Continued)

OTHER PUBLICATIONS

"Carding Lines", Sep. 30, 2011 (Sep. 30, 2011), XP055187614, Retrieved from the Internet: URL:http://www.autefa.com/fileadmin/user_upload/Nonwovens /Downloads /Autefa_Solutions_Carding_Lines.pdf [retrieved on May 6, 2015] the whole document.
(Continued)

*Primary Examiner* — Shaun R Hurley
(74) *Attorney, Agent, or Firm* — McGlew and Tuttle, P.C.

(57) ABSTRACT

A carding apparatus (2) and a carding method for producing a card web (12) are based on the carding apparatus (2) including a web forming device (5) for creating a preliminary web (3), followed by a web layering apparatus (7) which is followed by a card (6), and a controllable or adjustable profiling device (8). The profiling device (8) precedes or is associated with the web layering apparatus (7). The profiling device (8) is used for profiling the preliminary web (3) in order to preventively compensate for peripheral bulges in the card web (12) discharged by the card (6).

21 Claims, 2 Drawing Sheets

(51) Int. Cl.

| | |
|---|---|
| ***D04H 18/02*** | (2012.01) |
| ***D04H 18/04*** | (2012.01) |
| ***D01G 15/28*** | (2006.01) |
| ***D01G 15/42*** | (2006.01) |

(56) References Cited

U.S. PATENT DOCUMENTS

| | | | | |
|---|---|---|---|---|
| 3,373,461 | A * | 3/1968 | Bessette | D01G 15/08 19/105 |
| 3,999,249 | A * | 12/1976 | Katoh | D01G 15/36 19/0.2 |
| 4,128,917 | A * | 12/1978 | Varga | D01G 15/12 19/105 |
| 4,416,936 | A * | 11/1983 | Erickson | B32B 5/26 442/405 |
| 5,285,554 | A | 2/1994 | Jean et al. | |
| 5,590,442 | A | 1/1997 | Hirschek et al. | |
| 5,623,748 | A * | 4/1997 | Bacchio | D01G 21/00 19/163 |
| 6,085,391 | A | 7/2000 | Schaffler | |
| 6,195,844 | B1 | 3/2001 | Jourde et al. | |
| 7,111,366 | B2 * | 9/2006 | Pinto | D01G 15/02 19/65 A |

FOREIGN PATENT DOCUMENTS

| | | | |
|---|---|---|---|
| DE | 10 2004 063 401 | A1 | 7/2006 |
| DE | 20 2009 012 819 | U1 | 3/2011 |
| EP | 0 315 930 | A2 | 5/1989 |
| EP | 0 315 930 | A3 | 4/1990 |
| EP | 0 517 568 | A1 | 12/1992 |
| EP | 0 521 973 | A1 | 1/1993 |
| EP | 0 659 220 | A1 | 6/1995 |
| EP | 0 659 220 | B1 | 12/1997 |
| EP | 0 865 521 | B1 | 9/1999 |
| EP | 1 057 906 | A1 | 12/2000 |
| EP | 1 285 982 | A1 | 2/2003 |
| EP | 0 609 907 | B1 | 11/2004 |
| EP | 1 493 854 | A1 | 1/2005 |
| EP | 1 009 871 | B1 | 2/2005 |
| EP | 2 014 813 | A1 | 1/2009 |
| EP | 1 643 022 | B1 | 9/2010 |
| WO | 91/15618 | A1 | 10/1991 |
| WO | 94/05836 | A1 | 3/1994 |
| WO | 99/24650 | A1 | 5/1999 |
| WO | 02/101130 | A1 | 12/2002 |
| WO | 2004/013390 | A1 | 2/2004 |

OTHER PUBLICATIONS

"Crosslapping", Sep. 30, 2011 (Sep. 30, 2011), XP055187814, Retrieved from the Internet: URL:http://www.autefa.com/fileadmin/user_upload/Nonwovens/Downloads/Autefa_Solutions_Crosslapping.pdf [retrieved on May 6, 2015] the whole document.

Norbert Kühl et al: "Konzepte zur Qualitätssteigerung in der Vliesstoffherstellung", 25. Hofer Vliesstofftage, Nov. 11, 2010 (Nov. 11, 2010), XP055187812, Hof Retrieved from the Internet: URL:http://www.hofer-vliesstofftage.de/vortraege/2010/2010-19.pdf [retrieved on May 6, 2015] p. 9-p. 15.

* cited by examiner

CARDING APPARATUS AND CARDING METHOD

CROSS REFERENCE TO RELATED APPLICATIONS

This application is a United States National Phase Application of International Application PCT/EP2015/053961 filed Feb. 26, 2015 and claims the benefit of priority under 35 U.S.C. § 119 of German Application 20 2014 100 908.6 filed Feb. 27, 2014, the entire contents of which are incorporated herein by reference.

FIELD OF THE INVENTION

The present invention pertains to a carding apparatus for producing a fibrous web, especially carded web, with a card, to a Nonwoven production plant with such a carding apparatus for producing a fibrous web, especially a carded web, and with a downstream nonwoven-layering apparatus for layering a single-layer or multi-layer nonwoven and to a carding method for producing a fibrous web, especially carded web, with a card.

BACKGROUND OF THE INVENTION

Such carding apparatuses are known from practice. They include a single card, which produces and releases a fibrous web. The fibrous web may be fed to a downstream nonwoven-layering apparatus, which forms a multi-layer nonwoven from this, which is subsequently bonded with a needle loom or the like.

SUMMARY OF THE INVENTION

An object of the present invention is to provide an improved carding technique.

This object is accomplished by the present invention with a carding apparatus and the carding method have the advantage that the quality of the finished end product, especially of a bonded nonwoven, can be already be influenced during the carding process. In particular, effects of the card on the fibrous web released by the carding apparatus, the so-called carded web, can be specifically taken into account and especially compensated.

A card of a common design tends to generate a smile effect and peripheral bulges in the released carded web. This can be compensated with the carding technique according to the invention and the profiling of the fibrous web being fed, the so-called preliminary web, so that the carded web released has, e.g., a constant web thickness and constant area weight over the entire width and optionally also over the length. The carded web released may, on the other hand, also receive, taking the effects of the card into account, a different desired profile, which is favorable for the subsequent processing processes.

A web thickness constant over the width of the carded web and a constant area weight are advantageous for a subsequent layering (laying) process and the formation of a single-layer or multi-layer nonwoven. Exact layer closure can thus be achieved in the nonwoven. The web released has a constant thickness over its length and a constant area weight. This is favorable for the subsequent process and avoids the development of vibrations and accompanying production problems there. In particular, undesired inhomogeneities and corresponding defects in the end product can be reliably avoided. This applies to all nonwovens and especially to nonwovens with a very great layering width exceeding 8 m, especially 16 m and more as well as to corresponding nonwoven-layering apparatuses (laying apparatus), so-called paper felt layering devices.

The carding technique according to the invention is especially suitable for such great layering widths. The carding technique also makes it possible to increase the layering width of the end product in multiple steps. This may happen on the basis of an initially narrow preliminary web, which is significantly broadened by the web-layering apparatus, especially a crosslapper, during laydown. As a result, the carded web can thus already release a broad carded web for the subsequent process, especially the downstream nonwoven-layering apparatus or paper felt-layering apparatus. The increased layer width likewise has a favorable effect on the homogeneity of said end product.

The influencing of the profile and the arrangement of the profiling device in front of the web-layering apparatus and prior to the layering process proper have advantages in terms of influencing and accurately setting the profile formation in the preliminary web. The location and the extent of the profile or thickness change can be determined freely and accurately within broad limits. This may take place especially in a plurality of steps, which is especially favorable for sensitive preliminary webs. In addition, stable and accurately controllable profiling of the preliminary web can be achieved despite elastic restoring forces in the preliminary web. A corresponding convex preliminary web profile is advantageous for compensating card effects.

The profile may be influenced at one location or a plurality of locations. The profile of the preliminary web can already be produced in the web-forming device and the web-layering apparatus. especially in the inlet area thereof. This is brought about preferably by forming a local draft in the moving preliminary web, which may be brought about by drafting and/or upsetting. These draft points generated in the feed can then be placed by the web-layering apparatus specifically on the laid and released preliminary web. It is advantageous if the web-layering apparatus is configured as a crosslapper for this.

The effects of the card errors can be compensated by means of a specific profiling in the preliminary web fed by the web-layering apparatus in the above-mentioned manner. If needed, the carded web profile released by the card can be specially set. The card effects are taken into account in all cases in the previous profiling of the fibrous web or preliminary web. This process can be controlled and, if needed, also adjusted, and a suitable measuring device is arranged at a suitable location, especially behind the card.

The carding technique according to the invention has, furthermore, the advantage that the web-layering apparatus can lay with constant layering width. This is advantageous for the constant run of the web-layering apparatus and avoids problems with fluctuating web lengths and web moving speeds, which are known from crosslappers that operate with variable layering widths, e.g., according to EP 1 009 871 B1.

The carding technique according to the invention makes it, furthermore, possible, by means of a compensating device arranged at a suitable location, to feed the laid preliminary web to the card at constant speed. Any fluctuation in speed that may arise from the profiling process can now be compensated. The card can operate as a result with optimal efficiency. In addition, undesired changes in the web thickness or the area weight in the longitudinal direction of the preliminary web fed to the card can be avoided.

On the other hand, it may be advantageous to arrange a web drafter between the web-layering apparatus and the card, which brings about drafting of the laid preliminary web. The fibers in the web can be optimally aligned hereby and the preliminary web can be made uniform in the longitudinal direction or moving direction. The use of a web drafter also makes it possible, on the other hand, to reduce the size and possibly simplify the design of the downstream card.

The present invention is schematically shown in the drawings as examples. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
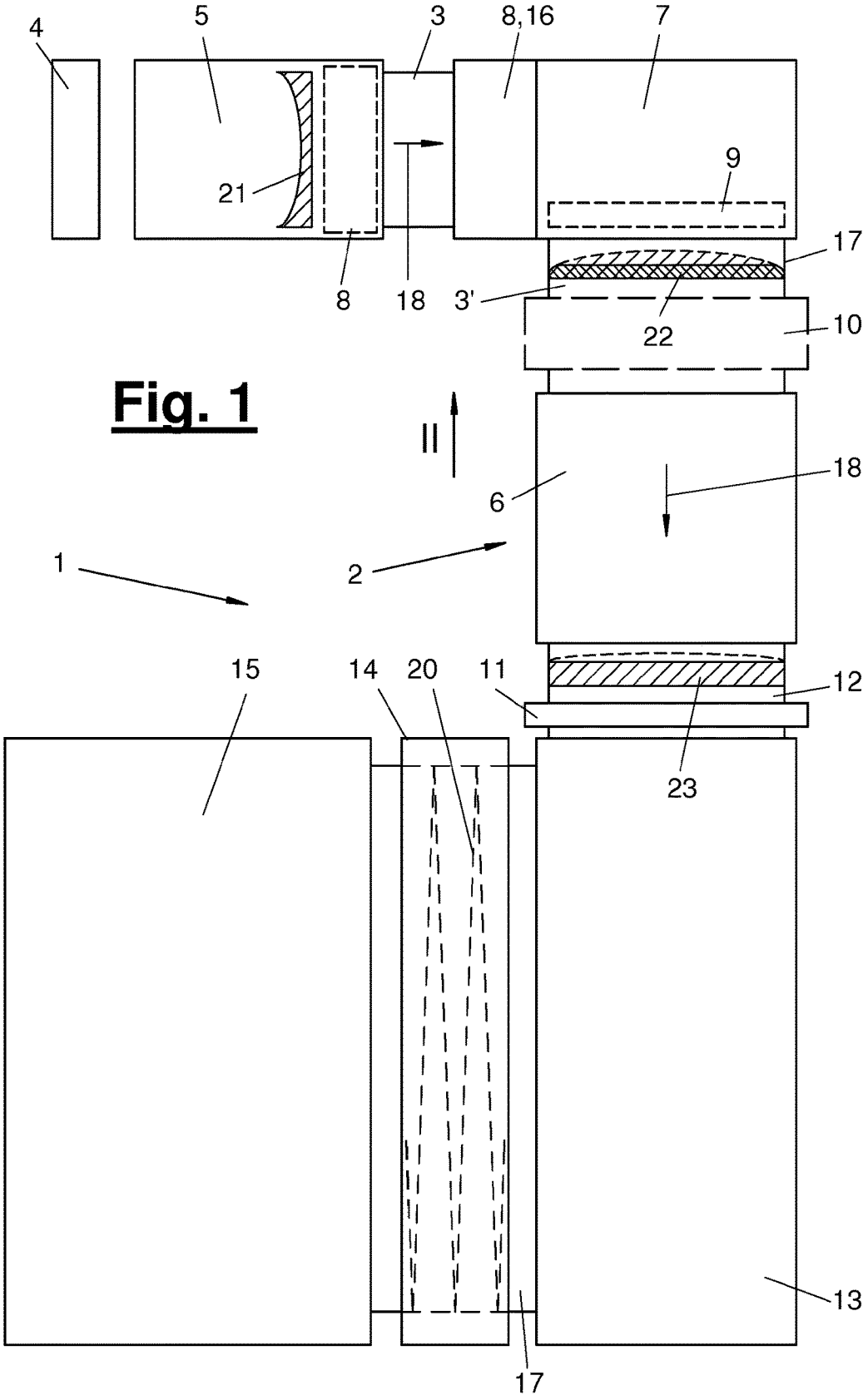
FIG. 1 is a schematic top view of a nonwoven production plant with a carding apparatus.

Referring to the drawings, the present invention pertains to a carding apparatus (2) and to a carding method for producing a fibrous web (3).

The present invention pertains, furthermore, to a nonwoven production plant (1) and to a production method for a single-layer or multi-layer fibrous web (20), which will hereinafter be called a nonwoven. It is produced from the aforementioned fibrous web (3).

FIG. 1 schematically shows a nonwoven production plant (1) with a carding apparatus (2). The carding apparatus (2) is used to produce and release a fibrous web (3), which will hereinafter be called a carded web. The carding apparatus (2) may be connected on an outlet side to other components of the plant. These may be, e.g., in the embodiment shown, a nonwoven-layering apparatus (13) followed by a processing device (15) for the preferably multi-layer nonwoven (20) released from the nonwoven-layering apparatus (13).

The carded web (12) may possess adjustable properties. It preferably has an adjustable and selectable thickness profile (23) and a corresponding area weight in the direction of the breadth or at right angles to the web run direction (18). FIG. 1 shows different web profiles (21, 22, 33) formed in the carding process with shadings.

The profile (23) of the carded web (12) is preferably uniform over the width and has a rectangular cross section. In addition, the web profile may also be set in a suitable manner in the longitudinal direction of the moving carded web (12).

The carding apparatus (2) has a web-forming device (5), a web-layering apparatus (7) and a card (6), which are arranged one after another in the web run direction (18). The carding apparatus (2) has, further, a profiling device (8), which is arranged upstream of the web-forming device (5). The carding apparatus (2) may have, in addition, further, optionally interposed or downstream components (9, 10, 11).

The web-forming device (5) produces a single-layer or multi-layer fibrous web (3), which will hereinafter be called a preliminary web. The web-forming device (5) may be configured, e.g., as a card and have a feeder (4) or another suitable processing device for fibers. As an alternative, the web-forming device (5) may also be configured as an airlay apparatus or in another other suitable manner.

The web-layering apparatus (7) lays the preliminary web (3) fed from the web-forming device (5) on a laydown conveyor (17) as a single layer or in a plurality of layers one on top of another and forms a laid preliminary web (3'). This laid fibrous web or preliminary web (3') is preferably also called a preliminary nonwoven. The web-layering apparatus (7) is preferably configured as a crosslapper, which deposits the fed preliminary web (3) on its moving laydown conveyor (17) oriented at right angles or obliquely to the web feed direction (18) and lays in a zigzag shape in relation to the laid preliminary web (3'). FIG. 1 shows this layer formation in the case of the nonwoven (20).

The web-layering apparatus (7) lays the preliminary web (3') preferably with a constant layering width. The web may be deposited with accurate layer closure. The front edge of a next layer may accurately join the rear edge of a web layer deposited previously or may come to lie over this.

The preliminary web (3) released from the web-forming device (5) may have, e.g., the web profile (21) schematically shown in FIG. 1 with peripheral bulges, i.e., the so-called smile effect. These peripheral bulges can be compensated in the web-layering apparatus (7). This can be achieved, e.g., by forming a preliminary web (3') with a plurality of layers, e.g., 20 layers or more, and with correspondingly small layer angles. The fed preliminary web (3) may have a very small thickness in this case.

The web-layering apparatus (7) is configured, e.g., as a belt layer with a plurality of, e.g., two, reversing driven main carriages and a plurality of endless and circulating driven conveyors guided over the main carriages. The two upper and lower main carriages are also called upper carriage and layering carriage. The web-layering apparatus (7) may have, in addition, one or more auxiliary carriages, especially tensioning carriages, over which at least one conveyor each is likewise guided. The conveyors take up the preliminary web (3) between them in at least some sections and they hold and guide it on the underside and on the top side. This conveyor area extends especially between the main carriages. The main carriages and possible auxiliary carriages are mounted and guided movably in a machine frame and are coupled in a suitable manner, and they move reversing to and fro above the laydown conveyor (17), e.g., a laydown belt. The main carriages preferably perform a synchronous motion, during which they are moving in the same direction and at different speeds as well as over different path lengths. Their motion of direction is preferably at right angles to the laydown conveyor (17). Such a web-layering apparatus (7) is configured, e.g., according to DE 10 2004 063 A1 or EP 0 865 521 B1 or EP 0 517 568 A1.

The profiling device (8) is used to profile the preliminary web (3) and is arranged in front of the web-layering apparatus (7) and precedes the layering process. The profiling device (8) can be controlled or adjusted. It may also be used to avoid peripheral bulges in the laid preliminary web (3'). The profiling device (8) produces variable thicknesses in the moving preliminary web (3), which extend over the width of said preliminary web and have a defined position and length on the moving formed fabric web in the longitudinal direction of the preliminary web. The variable thicknesses are produced with a defined lead before the laydown process in the web-layering apparatus (7), so that they are located at the desired locations of the laid preliminary web (3'), especially at bilateral peripheral areas thereof, after laydown of the web.

The changes in thickness are preferably thin areas in the preliminary web (3). The thin areas are preferably produced by a specific drafting of the moving preliminary web (3). There are different possibilities for the design embodiment and for the arrangement of the profiling device (8). In particular, a plurality of profiling devices (8) may be present as well.

Figure 2:
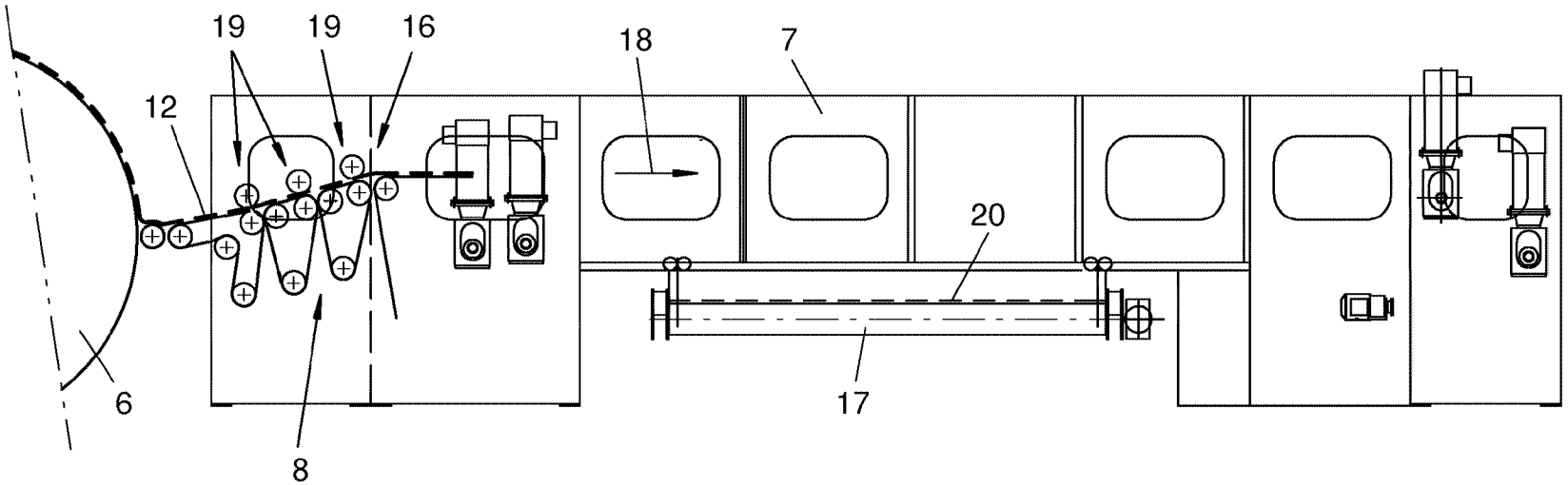
FIG. 2 is a front view of the web-layering apparatus of the carding apparatus according to arrow II in FIG. 1.

FIGS. 1 and 2 show a first variant, in which the profiling device (8) is configured as a controllable or adjustable drafting device for the preliminary web (3). The profiling device (8) is arranged in the area between the web-forming device (5) and the web-layering apparatus (7). In the exemplary embodiment being shown, they are located in the inlet area (16) of the web-layering apparatus (7) and in front of the main carriage thereof.

When the profiling device (8) is configured as a drafting device, it preferably has, according to FIG. 2, two or more drafting sections (19), which are arranged one after another in the web run direction (18). The drafting sections (19) have a pair each of adjustable rollers and/or belt sections. Such a profiling device (8) may be configured, e.g., according to WO 02/101130 A1.

Another possible configuration is according to EP 1 285 982 A1 or EP 0 659 220 B1, in which case the drafting device is located in a conveying area between the web-forming device (5) and the web-layering apparatus (7).

The profiling device (8), especially as a drafting device, may also have only one drafting section in one embodiment. The drafting section or drafting sections (19) is/are formed between clamped points of the preliminary web (3).

FIG. 1 illustrates by broken lines, in addition, a variant, in which the profiling device (8) is arranged, as an alternative or in addition, in the web-forming device (5). Thin areas or thick areas in the web may be formed here in the web in different ways, e.g., by changing the distance between a doffer and a swift of a card, by condensing rollers or by varying the laydown speed of the laydown device. Such a web-forming device (5) with an integrated profiling device (8) may be configured, e.g., according to WO 99/24650 A1 or EP 0 315 930 A1.

The profiling device (8) may be arranged, in another variant, in the web-layering apparatus (7) and form the thickness profile (22) and the area weight profile of the preliminary web (2) during the laydown of the preliminary web (3) on the laydown conveyor (17). The laydown speed of the preliminary web (3) at the layering carriage and the travel speed of the layering carriage are set now such that they differ from one another. Such a profiling device (8) may be configured, e.g., according to EP 0 315 930 A2, EP 0 609 907 B1 or EP 0 521 973 A1. Further, a configuration according to the aforementioned EP 0 659 220 A1 is possible. The profiling device (8) is associated with the web-layering apparatus (7) in these cases.

The profiling device (8) is controlled or adjusted as a function of the behavior of the downstream card (6). In particular, peripheral bulges in the carded web (12), which are formed by the card (6) by centrifugal force, flying fibers or the like, are preventively compensated hereby. Due to this control or adjustment of the profiling device (8), the web-layering apparatus (7) thus produces a preliminary web (3'), with a web profile (22), which is adapted to the above-mentioned interfering effects or card errors. This is a web profile (22) in the width direction or in the cross section of the laid preliminary web (3'). This web profile (22) may have, e.g., the flat, essentially rectangular cross-sectional shape with thinned edges shown in FIG. 1 or the convexly bulging cross-sectional shape shown by broken line. The smile effect of the card (6) is specifically compensated hereby to the desired extent.

The profile formation may be such that the card (6) releases a carded web (12) with an area weight or thickness profile (23) constant over the width as shown in FIG. 1. On the other hand, it is possible that the cross-sectional profile (23) of the carded web (12) is different and has, e.g., the convex shape indicated by broken line. In addition, further cross-sectional profile shapes are possible.

In all these cases, the carded web (12) has a cross-sectional profile (23) in which said card effects are taken into account and compensated. The compensation may be a complete or partial compensation depending on the desired cross-sectional profile. In extreme cases, a compensation may also lie in a reinforcement of the smile effect if this is meaningful for the next process. The cross-sectional profile (23) shown and preferred with constant web thickness and constant area weight is advantageous for the next layering process and especially for great layering widths.

In the embodiment shown, the carding apparatus (2) has a measuring device (11), which is arranged downstream of the card (6) and which measures the web profile (23) of the released carded web (12) in the cross direction and/or in the longitudinal direction. It can detect the web thickness and/or the area weight in any suitable manner. This may take place, e.g., by a weighing process, a thickness measurement by refraction or scattering or the like as well as physical contact or in a contactless manner. The measuring device (11) is connected to the profiling device (8) for its adjustment. A suitable control, which may be configured as a separate control or may be integrated as a control module in the profiling device (8) and/or in the measuring device (11), may be interposed here. The other components of the carding apparatus (2) and possibly of the nonwoven production plant (1) may also be connected to the control.

The carding apparatus (2) may have, furthermore, a compensating device (9), which is intended and configured for making uniform the web moving speed of the preliminary web (3') fed to the card (6). Such a compensating device (9) may be arranged, e.g., between the laydown conveyor (17) and the card (6). It may be configured, e.g., as a compensating belt with variable sag according to EP 1 643 022 B1.

The compensating device (9) may be integrated in the web-layering apparatus (7) in another variant. Various possibilities are available for this as well. One variant provides for an enlarged travel path of the upper main carriage of the web-layering apparatus (7) and may be configured corresponding to WO 2004/013390 A1. On the other hand, it is possible to integrate the compensating device (9) in the laydown conveyor (17), especially in the end area thereof. Above all, the variations, generated by the profiling device (8) as a drafting device, in the web moving speed can be compensated with the compensating device (9). Further, it is possible to compensate variations in the web release from the laydown conveyor (17), which are due to the reversing main carriage of the web-layering apparatus (7). As a result, the laid preliminary web (3') can be fed to the card (6) with a constant conveying speed.

Further, it is possible to arrange a web drafter (10) between the web-layering apparatus (7) and the card (6). This brings about a reorientation of the fibers in the laid preliminary web (3') due to a multiple arrangement of trimmed rollers driven at different speeds. The laid preliminary web (3') is made uniform and drafted hereby in terms of its fiber orientation. The trimmed rollers may be arranged, e.g., in sets of two or three.

The web drafter (10) brings about a similar dissolution of the fiber composite produced by crosslapping as it also takes place in the card (6). This makes it possible, on the other hand, to correspondingly reduce the size of the card (6) and its components. The card (6) has, e.g., rotating swift and one or more doffers as well as optionally further rollers or drums. The card (6) may form one or more individual webs and produce the carded web (12) from this.

For the release of a single-layer or multi-layer carded web (12), the card (6) has a suitable conveying device, at which the above-mentioned measuring device (11) may also be arranged. The conveying device may be connected on the outlet side to another component of a nonwoven production plant (1).

The carding apparatus (2) may be manufactured and installed independently. It may be used especially instead of a conventional card, and an existing nonwoven production plant (1) may be retrofitted with it. On the other hand, it may be integrated in a new nonwoven production plant (1).

Another component of the nonwoven production plant (1) may be, e.g., the nonwoven-layering apparatus (13) shown in FIG. 1, which deposits the carded web (12) fed by the card (6) on its laydown conveyor (17) as a single-layer or multi-layer nonwoven (20). The nonwoven-layering apparatus (13) may be configured as a crosslapper, in which the laydown conveyor (17), e.g., a laydown belt, is oriented at right angles or obliquely to the web feed direction (18). The nonwoven is preferably formed with accurate layer closure.

The layering width of the nonwoven-layering apparatus (13) may be selectable. It may be especially very great and equal 8 m or more, especially 16 m or more. Such a nonwoven-layering apparatus (13) is called paper felt-layering device. The layering width of the nonwoven-layering apparatus (13) may be greater, especially substantially greater than the layering width of the web-layering apparatus (7). As a result, the web and layering width can be increased in the laid preliminary web (3') and in the nonwoven (20) starting from a narrow preliminary web (3) of the web-forming device (5) over a plurality of steps.

The nonwoven-layering apparatus (13) may have the same or similar configuration as the web-layering apparatus (7). It may be configured, in particular, as a belt layer with a plurality of reversingly driven main carriages as well as optionally coupled auxiliary carriages, especially support and tensioning carriages, and with a plurality of endless as well as circulatingly driven conveyors guided over them. The conveyors in this case take the carded web between them in at least some areas, and they hold and guide it, especially in the area between the main carriages.

A profiling device (not shown), which makes possible a profiling of the nonwoven (20) as needed in the cross direction and optionally also in the longitudinal direction, may likewise be associated with the nonwoven-layering apparatus (13). On the one hand, the above-mentioned peripheral bulges of a laid web or nonwoven (20) can be avoided as a result. A nonwoven (20) with constant thickness or with constant area weight over the width and optionally also over the length can be produced. On the other hand, other profilings of the nonwoven (20) over the width and/or the length are also possible.

Another component of the nonwoven production plant (1) may be the processing device (15) shown in FIG. 1. It is arranged downstream of the nonwoven-layering apparatus (13). The processing device (15) may be, e.g., a bonding device for the nonwoven (20), which is configured, e.g., as a needle loom or hydroentanglement device.

As an alternative or in addition, other embodiments of the processing device (15) are possible, and these may also be configured as multipart devices. For example, meltblown fibers may be applied to the nonwoven (20) to produce insulating material. These fibers have a very low thickness. Such a meltblown application device may also be arranged instead of the nonwoven-layering apparatus (13) or arranged upstream of it in another variation.

Further, it is possible to arrange a compensating device (14) between the nonwoven-layering apparatus (13) and the downstream processing device (15). This may be configured corresponding to the compensating device (9), and it may be integrated in the nonwoven-layering apparatus (13) or arranged between the nonwoven-layering apparatus (13) and the processing device (15).

Various variants of the embodiments shown and described are possible. The features of the exemplary embodiments and their variants may be combined and optionally also replaced with one another in any desired manner. Individual components may be eliminated, e.g., the compensating device (9, 14) and/or the web drafter (10). Further, design variants of the above-described devices and apparatuses are possible. A web-layering apparatus (7) or nonwoven-layering apparatus (13) does not have to be configured as a crosslapper, but may have another configuration. The configuration as a belt layer of the type mentioned is also not compulsory. As an alternative, a configuration as a camel-back layer or as a carriage layering device or another configuration is possible as well. The design embodiment of the upstream profiling device (9), the card (6), the compensating device (9, 14) and/or of the web drafter (10) may also vary beyond the above-mentioned variants.

While specific embodiments of the invention have been shown and described in detail to illustrate the application of the principles of the invention, it will be understood that the invention may be embodied otherwise without departing from such principles.

The invention claimed is:

1. A carding apparatus for producing a fibrous carded web, the carding apparatus comprising:

a web-forming device forming a fibrous preliminary web;

a downstream web-layering apparatus; and a card following the web-layering apparatus; and a controllable or adjustable profiling device arranged upstream of the web-layering apparatus or associated with the web-layering apparatus and profiling the preliminary web, wherein the profiling device is arranged in the web-forming device and/or the profiling device is arranged in an area between the web-forming device and the web layering apparatus wherein the profiling device is configured as a controllable or adjustable drafting device for the preliminary web and the profiling device is arranged in an inlet area of the web-layering apparatus.

2. A carding apparatus in accordance with claim 1, wherein the profiling device is controlled or adjusted such that the web-layering apparatus releases a laid preliminary web with a web profile that preventively compensates peripheral bulges, which are formed, by the card, in a carded web.

3. A carding apparatus in accordance with claim 1, wherein the profiling device is controlled or adjusted such that the card releases a carded web with an area weight or thickness profile that is constant over a width of the carded web.

4. A carding apparatus in accordance with claim 1, wherein the carding apparatus further comprises a measuring device arranged downstream of the card which measures an area weight or a web thickness, in the cross direction and/or in the longitudinal direction of the carded web wherein the measuring device is connected to the profiling device for adjusting same.

5. A carding apparatus in accordance with claim 1, wherein the profiling device has two or more drafting sections.

6. A carding apparatus in accordance with claim 1, further comprising a compensating device configured for making uniform the web moving speed of the laid preliminary web fed to the card.

7. A carding apparatus in accordance with claim 1, further comprising a web drafter arranged between the web-layering apparatus and the card.

8. A carding apparatus in accordance with claim 1, wherein the web-layering apparatus is configured as a cross-lapper with a laydown conveyor directed at right angles or obliquely to a web run direction.

9. A nonwoven production plant comprising:

a carding apparatus for producing a fibrous carded web, and a downstream nonwoven-layering apparatus for layering a single-layer or multi-layer nonwoven, wherein the carding apparatus comprising:

a web-forming device forming a fibrous preliminary web;

a preliminary web-layering apparatus downstream of the web-forming device for layering the preliminary web;

a card following the preliminary web-layering apparatus; and a controllable or adjustable profiling device arranged upstream of the preliminary web-layering apparatus or associated with the preliminary web-layering apparatus and profiling the preliminary web, wherein the profiling device is arranged in the web-forming device and/or the profiling device is arranged in an area between the web-forming device and the web-layering apparatus wherein the profiling device is configured as a controllable or adjustable drafting device for the preliminary web and the profiling device is arranged in an inlet area of the web-layering apparatus.

10. A nonwoven production plant in accordance with claim 9, further comprising a downstream processing device, wherein the nonwoven-layering apparatus is connected to the downstream processing device and the downstream processing device comprises a bonding device, for the released nonwoven.

11. A nonwoven production plant in accordance with claim 9, wherein the nonwoven-layering apparatus has an integrated or downstream compensating device for fluctuating web moving speeds.

12. A nonwoven production plant in accordance with claim 9, wherein the nonwoven-layering apparatus has a greater layering width than the preliminary web-layering apparatus.

13. A method for producing a fibrous carded web, with a card, the method comprising the steps of:

producing a fibrous preliminary web by a web-forming device of a carding apparatus;

feeding the produced fibrous preliminary web to a downstream web-layering apparatus and to a card arranged downstream of the web-layering apparatus;

profiling the fibrous preliminary web in a controllable or adjustable profiling device arranged upstream of or associated with the web-layering apparatus, wherein the profiling device is arranged in the web-forming device and/or the profiling device is arranged in an area between the web-forming device and the web-layering apparatus wherein the profiling device is configured as a controllable or adjustable drafting device for the preliminary web and the profiling device is arranged in an inlet area of the web-layering apparatus.

14. A method in accordance with claim 13, wherein peripheral bulges in the carded web, which are formed by the card due to centrifugal forces, flying fibers or centrifugal forces and flying fibers, are preventively compensated by the profiling of the fibrous web.

15. A method in accordance with claim 14, wherein a fibrous carded web, with a profile that can be set over a width and also over the length, is released by the carding apparatus.

16. A method in accordance with claim 13, wherein the profile of the fibrous preliminary web, is formed by a local draft in the moving preliminary web by drafting and/or upsetting, wherein these draft points are placed specifically by the web-forming device on the laid and released preliminary web.

17. A method in accordance with claim 13, wherein the carded web released by the card is fed to a nonwoven-layering apparatus, wherein the carded web released by the card is fed to a processing device comprising a bonding device.

18. A method in accordance with claim 13, wherein starting from a narrow fibrous preliminary web, of the web-forming device, the web and layering width is increased over a plurality of steps.

19. A carding apparatus for producing a fibrous carded web, the carding apparatus comprising:

a web-forming device forming a fibrous preliminary web;

a downstream web-layering apparatus; and a card following the web-layering apparatus; and a controllable or adjustable profiling device arranged upstream of the web-layering apparatus or associated with the web-layering apparatus and profiling the preliminary web, wherein the carding apparatus further comprises a measuring device arranged downstream of the card which measures an area weight or a web thickness, in the cross direction and/or in the longitudinal direction of the carded web wherein the measuring device is connected to the profiling device for adjusting same.

20. A carding apparatus in accordance with claim 19, wherein the profiling device is controlled or adjusted such that the web-layering apparatus releases a laid preliminary web with a web profile that preventively compensates peripheral bulges, which are formed, by the card in a carded web.

21. A carding apparatus in accordance with claim 19, wherein the profiling device is controlled or adjusted such that the card releases a carded web with an area weight or thickness profile that is constant over a width of the carded web.

* * * * *